US005318845A

United States Patent [19]

Tanaka et al.

[11] Patent Number: 5,318,845

[45] Date of Patent: Jun. 7, 1994

[54] CONDUCTIVE COMPOSITE FILAMENT AND PROCESS FOR PRODUCING THE SAME

[75] Inventors: Kazuhiko Tanaka; Yoshiteru Matsuo, both of Kurashiki; Eiichirou Nakamura, Takatsuki; Shoji Asano; Masao Kawamoto, both of Kurashiki, all of Japan

[73] Assignee: Kuraray Co., Ltd., Kurashiki, Japan

[21] Appl. No.: 4,186

[22] Filed: Jan. 13, 1993

Related U.S. Application Data

[63] Continuation of Ser. No. 673,282, Mar. 21, 1991, abandoned, which is a continuation-in-part of Ser. No. 358,398, May 26, 1989, abandoned.

[30] Foreign Application Priority Data

May 27, 1988 [JP] Japan ..... 63-130745

[51] Int. Cl.[5] ..... D02G 3/00

[52] U.S. Cl. ..... 428/373; 428/372; 428/399; 57/210; 57/227; 57/228; 57/244; 57/245; 57/905

[58] Field of Search ..... 57/210, 227, 228, 244, 57/248, 905, 245; 428/370, 364, 373, 399, 372

[56] References Cited

U.S. PATENT DOCUMENTS

| | | | |
|---|---|---|---|
| 3,551,279 | 12/1970 | Ando et al. | 428/373 |
| 3,681,910 | 9/1972 | Reese | 57/244 |
| 3,803,453 | 4/1974 | Hull | 57/244 |
| 4,085,182 | 4/1978 | Kato | 264/171 |
| 4,154,881 | 5/1979 | Hirakawa et al. | 57/227 |
| 4,207,376 | 6/1980 | Nagayasu et al. | 428/368 |
| 4,330,989 | 5/1982 | Schnieder et al. | 57/227 |
| 4,457,973 | 7/1984 | Matsui et al. | 428/374 |
| 4,743,505 | 5/1988 | Yamada | 428/373 |
| 4,756,969 | 7/1988 | Takeda | 428/372 |

FOREIGN PATENT DOCUMENTS

| | | |
|---|---|---|
| 0343496 | 11/1989 | European Pat. Off. . |
| 56-169810 | 12/1981 | Japan . |
| 61-56334 | 11/1982 | Japan . |
| 59-47474 | 3/1984 | Japan . |
| 60-110920 | 6/1985 | Japan . |
| 61-102474 | 5/1986 | Japan . |
| 64-52816 | 2/1989 | Japan . |

*Primary Examiner*—Patrick J. Ryan
*Assistant Examiner*—N. Edwards
*Attorney, Agent, or Firm*—Barry Kramer

[57] ABSTRACT

A highly oriented, undrawn, conductive, composite filament is provided, which is white or colorless and has antistatic properties durable over a long period when clothing utilizing the fiber are actually put on and washed. The filament is a sheath-core composite filament comprising a sheath of a fiber-forming thermoplastic polymer (A) and a core of a composition (B) comprising a conductive material which comprises a conductive metal oxide and a thermoplastic polyamide, having a core resistance of not more than $9\times10^{10}$ Ω/cm·filament, the composite filament maintaining a critical elongation—an elongation reached in the course of extending a composite filament at which the core resistance exceeds $1\times10^{11}$ Ω/cm·filament at a D.C. voltage of 1 kV—of at least 5% and a shrinkage in hot water at 100° C. of not higher than 20%. Such fiber can be obtained by conducting high orientation melt spinning at a rate of at least 2,500 m/min while selecting a polyamide as the core component to contain the white or colorless conductive material and having the composition previously dried to a moisture content of 100 to 1,200 ppm.

3 Claims, 2 Drawing Sheets

CONDUCTIVE COMPOSITE FILAMENT AND PROCESS FOR PRODUCING THE SAME

This application is a continuation of application Ser. No. 07/673,282, now abandoned, filed Mar. 21, 1991, which, in turn, is a continuation-in-part of application Ser. No. 07/358,398 filed May 26, 1989, now abandoned.

BACKGROUND OF THE INVENTION

1. Field of the Invention

This invention relates to a composite filament having excellent antistatic properties, and more particularly to a white, highly oriented, undrawn, conductive filament having excellent filament properties and antistatic properties which are durable when the clothing made thereof is worn.

More specifically, the present invention relates to a white, sheath-core composite filament having excellent antistatic properties, which comprises a sheath component of a fiber-forming polymer (A) and a core component of a thermoplastic polymer (B) containing a compound comprising a conductive material which comprises a metal oxide(s). The addition of an amount of only 0.01 to 10% by weight of this composite filament to a usual non-conductive fiber can provide the fabrics containing the fibers with excellent antistatic properties, which do not deteriorate even after being worn for one year.

2. Description of the Prior Art

Various conductive filaments have been proposed as having excellent antistatic properties. For example, there has been proposed a conductive filament comprising a conductive component which comprises a polymer containing a conductive carbon black mixed therein and a protective component which comprises a fiber-forming polymer.

However, such composite filaments utilizing a carbon black have a disadvantage, in that they are black or grey, and hence their use is limited.

Conductive filaments utilizing a white or colorless conductive metal oxide have recently been proposed to eliminate the above disadvantage. For example, Japanese Patent Application Laid-Open No. 6762/1982 and Japanese Patent Publication No. 29526/1987 propose a process of preparing a conductive composite filament comprising a mixture (conductive layer) of a conductive metal oxide and a thermoplastic resin and a fiber-forming thermoplastic polymer, said process comprising first preparing a composite filament as spun and drawing it and then further heat-treating the drawn filament to thereby restore the conductive layer. Where a thermoplastic resin is used as a binder for a conductive metal oxide, the obtained conductive layer is broken at the drawing process and as such the drawn filament cannot act as a conductive filament. Heat treatment is thus necessary when a thermoplastic resin, particularly a thermoplastic resin having high crystallinity, is used as the protective component for a conductive metal oxide. The process of the above patent, however, has a drawback of low productivity due to the presence of the heat treatment process after the heat drawing; and further the composite filament obtained by the process has a large drawback of insufficient durability when an article of clothing made thereof is actually worn. The "durability" of a composite filament herein is judged by whether or not the antistatic properties are still exhibited after a woven fabric comprising the conductive filament to be evaluated in an amount of 0.1 to 10% by weight has actually been worn for about 1 year. The standard for the upper limit of the static charge, specified in "Recommended Practice for Protection against Hazards Arising out of Electricity" in "Technical Recommendations" issued by Research Institute of Industrial safety of Labor Ministry, is 7 $\mu$ Coulomb/m$^2$. This standard for the durability has not been met by conventional white or colorless conductive composite filaments. It has become clear from a study made by the present inventors that a thermoplastic polymer of, for example, polyethylene cannot give a conductive filament having a sufficient durability and that a fabric comprising such filament is hence not suited for use in work wears used for dangerous jobs. In the case where a crystalline thermoplastic resin is used as the thermoplastic polymer, the obtained conductive composite filament just after being produced has an electric resistance of less than $9\times10^{10}$ $\Omega$/cm·filament which satisfies the static charge standard for fabrics. The filament, however, has a poor durability, and the fabric obtained therefrom hence has low antistatic properties and is difficult to put into practical use.

The present inventors have made a detailed study to obtain a conductive filament without the above-mentioned drawbacks, and, particularly, have intensively studied the relationship between the filament structure and the antistatic properties and the durability thereof, and found a composite filament having excellent antistatic properties and durability.

SUMMARY OF THE INVENTION

The present invention provides a highly oriented, undrawn, conductive, composite filament which is a sheath-core composite filament comprising a sheath of a fiber-forming thermoplastic polymer (A) and a core of a composition (B) comprising a conductive material which comprises a conductive metal oxide(s) and a thermoplastic polymer, said composite filament maintaining a critical elongation of at least 5% and a shrinkage in hot water at 100° C. of 20% or less, said thermoplastic polymer for the core being a polyamide, and said core having an electric resistance at a D.C. voltage of 1 kV of less than $9\times10^{10}$ $\Omega$/cm·filament.

BRIEF DESCRIPTION OF THE DRAWINGS

A more complete understanding of the invention and many of the attendant advantages thereof will be readily obtained by reference to the following detailed description when considered in connection with the accompanying drawings, wherein.

DETAILED DESCRIPTION OF THE PREFERRED EMBODIMENTS

As is well known, the term "antistatic properties" refers to the function of eliminating the static charge from a charged article by a non-contacting process. While a composite filament having a core resistance of less than $10^{11}$ $\Omega$/cm·filament can form a nonuniform electric field to thereby eliminate static charge by corona discharging, one having a core resistance of $10^{11}$ Ω/cm·filament or more cannot eliminate static charge by corona discharging and hence does not exhibit effective antistatic properties.

The present inventors have investigated the relationship between the critical elongation and the constituents of a filament and the durability of antistatic properties of a fabric comprising the filament. The "critical elongation" herein means an elongation reached in the course of extending a filament at which the core resistance exceeds $1\times10^{11}$ Ω/cm·filament at a D.C. voltage of 1 kV, that is, an elongation at which the filament loses its antistatic properties. As a result of the study, it was found that the durability is largely affected by the critical elongation and the type of the thermoplastic resin containing the conductive substance. The critical elongation varies from 0 to 15% in the case of white, conductive, composite filaments. It has been found, surprisingly, that a conductive composite filament with a critical elongation maintained at and above 5% can have a sufficient durability of antistatic properties.

The present inventors have pursued how to prepare white or colorless composite filaments containing a conductive metal oxide, which filaments have a critical elongation of at least 5%, and found that such filaments can be obtained when a polyamide is employed as the thermoplastic polymer for the core component and the moisture content of the core component during spinning is in a specific range.

Figure 1:
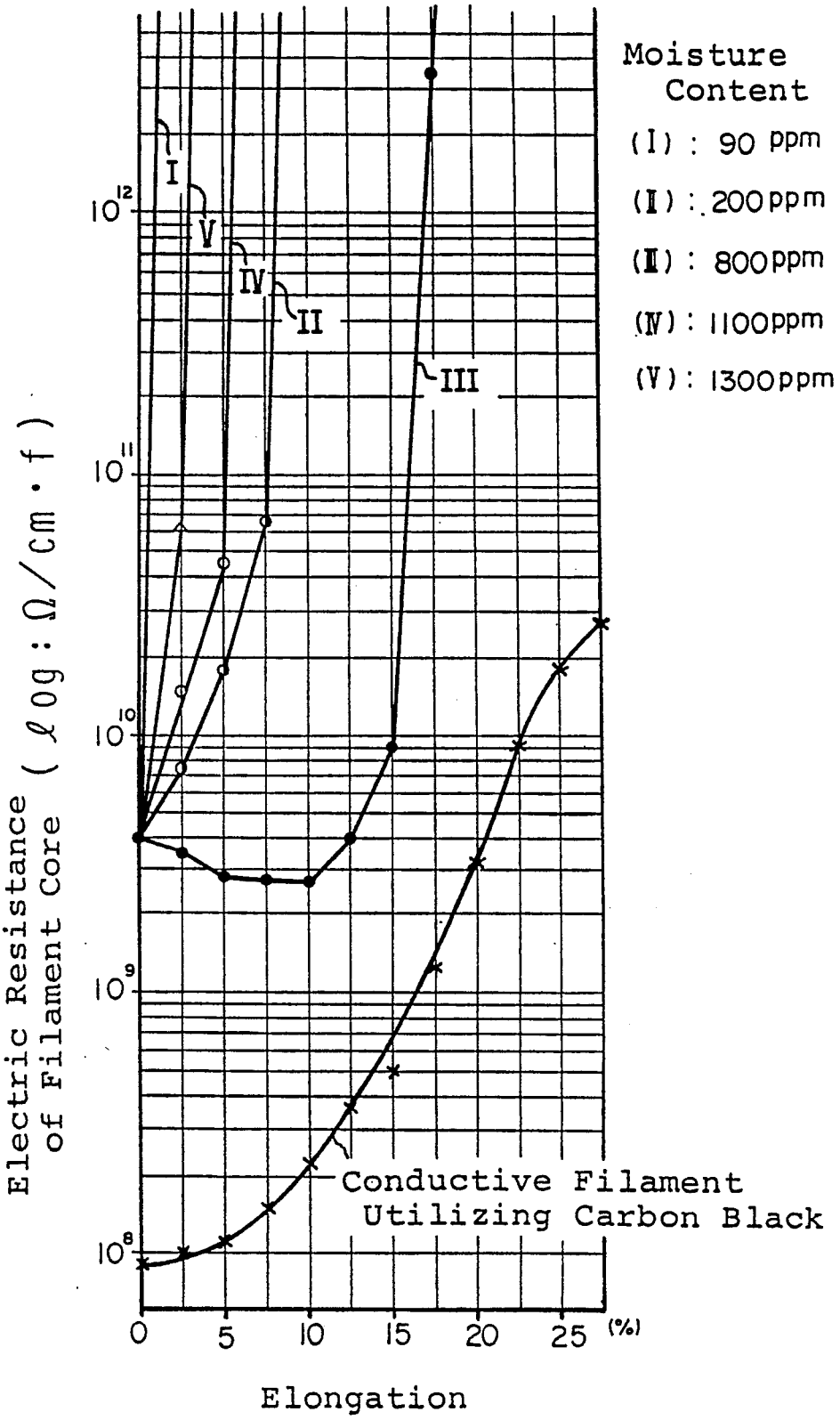
FIG. 1 is a graph showing the relationship between the elongation and the electric resistance (resistance of filament core) of a composite filament with the moisture content of the composition of the core component of the filament as a parameter.

FIG. 1 is a graph showing the relationship between the elongation and the electric resistance (resistance of filament core) when the moisture content of the core component is (I) 90 ppm, (II) 200 ppm, (III) 800 ppm, (IV) 1,100 ppm or (V) 1,300 ppm respectively. Where the moisture content is out of the range of from 100 to 1,200 ppm, that is, in the cases of (I) and (V), if the filament is elongated by at least 5% in the processing or in the actual service, i.e. in the region of elongation exceeding 5%, the core resistance will not fall below $1\times10^{11}$ Ω/cm·filament, and therefore cannot eliminate static charge by corona discharging. On the other hand, in the case of (IV) and (II), in which the moisture content of the core component falls in the range of from 100 to 1,200 ppm, even when the filament is elongated in the course of processing or in the actual service by 5%, the core resistance is of an order of $10^{10}$ Ω/cm·filament thereby being capable of eliminating static charge by corona discharging. Further in the case of (III), the core resistance remains below $10^{10}$ Ω/cm·filament even when the filament is subjected to elongation of 15% and thus has excellent durability.

FIG. 1 further shows that there is a large difference between the core resistance of filaments utilizing white conductive particles and that of conventional filaments utilizing carbon black as the conductive material. From the Figure it will be understood that a filament utilizing a white particulate conductive material has a conducting structure markedly more unstable than that of a carbon-black conductive filament. The present invention has made it clear that the former can exhibit antistatic properties applicable in practice only within a limited region inside the unstable region, i.e. within a limited region of the moisture content of the core component.

As stated heretofore, the present inventors have succeeded in markedly improving the durability of the antistatic properties of a white conductive filament by providing the filament with a core resistance at a D.C. voltage of less than 1 kV of $9\times10^{10}$ Ω/cm·filament and a critical elongation of at least 5%.

Although the mechanism of the present invention is not completely understood, it is believed to be as follows. If the moisture content of a polyamide resin is as low as 100 ppm or below when it is formed into a filament, the resin will tend to be fragile, thereby rendering the conductive structure unstable. On the other hand, if the moisture content is as much as 1,200 ppm of higher, bubbles, voids or the like will readily be generated, thereby forming minute defects in the conductive layer.

While the white conductive sheath-core composite filament used in the present invention comprises a core component of the above-described polyamide containing a white particulate conductive material, its sheath component is a polyethylene terephthalate or polybutylene terephthalate polymer. The polyethylene terephthalate or polybutylene terephthalate polymer has characteristics of being difficult to elongate when subjected to tensile stresses and hardly undergoing voluntary elongation after it has been spun as compared with polyamide and the like. If a polymer undergoing voluntary elongation after spinning is used for the sheath component, the core component, i.e. conductive layer will eventually break as the core is forced to gradually elongate with time, thereby losing its antistatic properties. Furthermore, the use of a polyethylene terephthalate or polybutylene terephthalate polymer as the sheath provides excellent durability both when the composite filament is processed and when finished clothes are worn.

The polyethylene terephthalate polymer and polybutylene terephthalate polymer herein include polymers comprising principally repeating units from ethylene terephthalate and butylene terephthalate, respectively. The polymers may also comprise a small amount of units from other dicarboxylic acids, diols or oxycarboxylic acids by copolymerization. The ratio of the copolymerization is preferably low, since the resistance to tensile stress decreases with increasing ratio of copolymerization. It is preferred that the polyethylene terephthalate or polybutylene terephthalate comprises units from ethylene terephthalate or butylene terephthalate in an amount of at least 85 mol %.

A more detailed explanation for the production conditions for obtaining such filaments is provided below.

The thermoplastic polymer constituting the core component must be a polyamide. It has been found that polyamides, e.g. nylon 6 give higher conductive characteristics than those obtained with polyethylene, which is generally employed.

When obtaining a conductive composite filament comprising as a component a conductive metal oxide(s) dispersed in a polymer, the important points are as follows.

(1) To assure a high conducting property by dispersing the metal oxide;

(2) to assure a good dispersion of the metal oxide in the obtained conductive polymer to thereby prevent any unusual filter clogging during spinning;

(3) to assure a good fluidity of the obtained conductive polymer;

(4) to assure good mechanical properties of the obtained conductive polymer; and the like.

From the above points of view, the present inventors have studied various polymers while dispersing a metal oxides(s) therein, and found that polyamides are the most suited. This is because polyamides have appropriate polar groups, and therefore exhibit good compatibility and adhesiveness with metal oxides. Hence, the fluidity of the polyamide does not decrease significantly when a metal oxide is incorporated therein in a high concentration. The dispersion thus exhibits both high conducting property and good fluidity. Furthermore, perhaps because of a firm adhesion between the metal oxide and polyamides, the obtained conductive polymer has very high mechanical properties. On the other hand, polyesters incorporating a metal oxide give, for some reason or another, a sharp viscosity increase and lose their fluidity, even in a low incorporation ratio. Thus, the polyesters do not provide a fiber-forming conductive polymer having the desired conducting property and do not compete with the polyamides. Polyolefins such as polyethylene can, upon incorporation of a metal oxide, give conductive polymers having a fluidity to some extend and at the same time a good conducting property. However, it has been found that the polyolefin conductive polymers rapidly lose their static eliminating performance in a short period of actual use and thus are not durable perhaps because they exhibit only a small adhesiveness with metal oxides, thereby weakening the mechanical properties of the obtained conductive polymer as compared to the case with polyamides. To summarize, polyamides are the best suited, among general-purpose polymers, for producing the conductive polymers to be used for conductive composite filaments.

Examples of preferred polyamides are nylon 6 and metaxylylenediamine nylon or polyamide blends comprising either of the foregoing as a principal component.

Any melt-spinnable polymer can be used as the fiber-forming polymer constituting the sheath of the conductive composite filament of the present invention. Examples of the fiber forming polymer include polyesters such as polyethylene terephthalate and polybutylene terephthalate, and polyamides such as nylon 6 and nylon 66. It is necessary that the intrinsic viscosity of the sheath-component polymer be at least 0.55. If a polymer having an intrinsic viscosity less than 0.55 is used as the sheath component, the melt viscosity during spinning will be too low to maintain a good balance with that of the conductive polymer layer, thereby rendering the composite structure unstable in the longitudinal direction. In such case, spinnability becomes worse, particularly at a high speed of not less than 2,500 m/min, and frequent filament breakages occur, which is not preferred. Where a polyamide is used as the sheath component, the intrinsic viscosity is preferably at least 0.7. Particularly preferred thermoplastic polymers constituting the sheath are polyesters comprising as a principal component polyethylene terephthalate or polybutylene terephthalate, since they provide a markedly improved durability against processing or when actually worn.

The conductive filament of the present invention is generally used while being mixed in a fabric in an amount of 0.1 to 10% by weight, which is the same as in the case of other conductive filaments. These fabrics are usually finished by dyeing and finishing process, during which the core component of the conductive filament is easily damaged, since it is fragile because of high content of a conductive metal oxide. Particularly, where fabrics comprising a conductive filament undergo high-temperature dyeing or high-temperature setting, the core component is significantly affected. In such situations, the filament strength is decreased and will thus readily break by the bending which occurs during practical use, thus leading to a drop-off or deterioration of the conductive layer. Employment of a polyester, e.g. polyethylene terephthalate not only maintains the mechanical properties of the sheath component, but causes no decrease in the performance.

The conductive material to be incorporated into the core component is a white or colorless particulate metal oxide, with or without a doping agent, which is also a metal oxide, or a particulate inorganic material having the metal oxide coating on the surface thereof. A preferred example of the latter is fine particles having an average diameter of 0.01 to 0.3 $\mu$ of titanium dioxide or barium sulfate coated with stannic oxide or zinc oxide containing antimonium oxide.

The majority of metal oxides are semiconductors close to non-conductors which do not exhibit sufficient conductive property. However, the addition of a small amount of a second component to a metal oxide or the like can increase the conductive property and give a sufficiently conductive material. Antimonium oxide and like oxides are known as such conductivity increasing agents or "doping agents" for stannic oxide or zinc oxide. For example, while particulate stannic oxide having an average particle diameter of 0.1 $\mu$ has a specific resistance of about $10^3$ $\Omega$·cm, solid solutions of antimonium oxide in stannic oxide have specific resistances of from 1 to 10 $\Omega$·cm. The ratio by weight of antimonium oxide contained in a particulate conductive material is required to be 0.01 to 0.10 in view of overall performance. The ratio by weight of stannic oxide or zinc oxide contained in a particulate conductive material is preferably in the range from 0.05 to 0.20. Too small a coating amount leads to insufficient conductivity, while too large an amount will cause the obtained particulate material to deviate from the white color.

The particulate conductive material is contained in the core of the composite filament of the invention in an amount of 60 to 75% by weight. While a content of less than 60% by weight cannot give a sufficient conductivity to exhibit the desired antistatic properties; one exceeding 75% by weight is not preferred since it will not further increase the conductivity and will markedly decrease the fluidity of the core component, whereby the spinnability is extremely worsened and, particularly, the life of the spinneret pack is strikingly shortened due to filter clogging or the like, thus rendering the spinning operation unstable.

For the filaments of the present invention, it is also important that the ratio by weight of the fiber-forming thermoplastic polymer constituting the sheath (A) and the composition of a thermoplastic polyamide and a conductive material constituting the core (B) be: (B)/(A)=8/92 to 22/78. If the sheath component (A) exceeds 92% by weight and the conductive core component (B) is less than 8% by weight, a composite filament with a stable sheath-core structure cannot be spun stably and, particularly, it becomes difficult to obtain a longitudinally continuous core component to thereby provide the stable spinning of the sheath-core composite filament. On the other hand, if the core component (B) exceeds 22% by weight, the spinnability of the composite filament will, even when the sheath component (A) has a sufficient fiber-forming capability, decrease. Further, the obtained filament will have extremely low filament properties and be of no practical value. The reason for this is thought to be the low spinnability (low threading capability) of the core component decreases the threading capability of the entire composite filament because of the large percentage of the core component. Accordingly, the ratio by weight of the sheath component (A) to the core component (B) is: (A):(B)=78:22 to 92:8, preferably 80:20 to 90:10.

The conductive composite filament of the present invention can be obtained by a process which comprises separately extruding through different extruders (1) a fiber-forming thermoplastic polymer having an intrinsic viscosity, [n], of at least 0.55, which constitutes the sheath component, and (2) the composition constituting the core component having a moisture content adjusted by drying to 100 to 1,200 ppm and conducting high-speed spinning using a composite spinning apparatus. The high-speed spinning herein means melt-spinning at a rate of at least 2,500 m/min, so that the filaments thus spun will be highly oriented and have a shrinkage in hot water of 100° C., WSr, of not more than 20%.

If a core component (B) having a moisture content of less than 100 ppm is spun into a composite filament, filaments having a core resistance exceeding $10^{11}$ Ω/cm·filament will frequently be formed though the spinnability is good. If a core component (B) having a moisture content exceeding 1,200 ppm is spun into a composite filament, the spinnability will be low (with frequent filament breakages) and further many of the obtained conductive filaments will have critical elongations not more than 5%. Accordingly, the moisture content of the core component (B) is very important and preferably in the range of from 200 to 1,000 ppm, more preferably 300 to 800 ppm.

The wet shrinkage, WSr, of conductive filaments is also important, Generally, it is essential that textile fabrics be subject to after-processing, (after the weaving), in high-temperature hot water, such as scouring and relaxation, dyeing or the like. If the filament constituting the fabric has too large a wet shrinkage, the fabric will shrink during such processing which is not desired. Fibers for textile fabrics in general therefore must have wet shrinkages lower than about 20%. In addition, the conductive filament of the present invention is most frequently used while being mixed in a small amount into conventional fibers for purposes of economy. For example, a single strand of the conductive filament may be inserted at 1-inch intervals among a plurality of conventional warps for a fabric. In this case, if the conductive filament has a much larger wet shrinkage than that of neighboring warps, the conductive filament will be put under a high tension after the fabric has been wet treated, and will thus readily break when the fabric is loaded with an external force, which is often the case when clothes made of the fabric are actually put on.

The present invention conducts melt-spinning at a rate of at least 2,500 m/min to obtain highly oriented composite filaments having a shrinkage in hot water at 100° C. of not more than 20%. Since a high orientation melt spinning is conducted in the present invention, the drawing process is omitted. Therefore, the present invention eliminates the problems typically associated with the drawing process, such as cracks or breakages of the core component. Moreover, cut-off of the conducting circuit by drawing can also be avoided.

Further, it is important in the present invention that the above-described highly oriented, undrawn, conductive, composite filament constitute a sheath, or covering yarn, to form a combined filament yarn. The counterpart core for such combined filament yarn is constituted by a non-conductive polyethylene terephthalate multifilament yarn. Polyethylene terephthalate multifilament yarns have high extensional resistance and further high processing durability and durability in use, thereby preventing the sheath yarn comprising the conductive composite filament from breaking under high tensile stresses during processing or use. It is essential that the core comprising a non-conductive multifilament yarn have a smaller yarn length than that of the sheath yarn comprising the conductive composite filament. Thus, the range of the ratio of the yarn length of the sheath is 100.5 to 115% based on 100% of the yarn length of the core. With the ratio being less than 100.5%, the sheath suffers high tensile stress during use, thereby gradually decreasing its antistatic properties. With the ratio exceeding 115%, the conductive filament projects frequently out of the surface of the fabric being worn, whereby the projected parts are worn away to decrease the antistatic properties. This difference in the yarn length between the conductive composite filament and the non-conductive multifilament yarn used still more effectively prevents the conductive composite filament from suffering excess stress which may lead to the breakage of the conductive layer, when the combined filament yarn is put under tension. It is also important that the non-conductive polyethylene terephthalate multifilament yarn constituting the core have higher Young's modulus and tensile strength than those of the conductive composite filament constituting the sheath. If the conductive composite filament is higher in one or both of these properties, its conductive layer will, similarly to the above, break by tension occasionally applied to the conductive composite filament. The non-conductive polyethylene terephthalate multifilament yarn that satisfies the above conditions of Young's modulus and tensile strength can, for example, be obtained by extruding a melted polyethylene terephthalate or copolyester comprising principally repeating units from ethylene terephthalate through a spinneret, taking up the extruded melts at a rate of 500 to 4,500 m/min and then drawing the resulting as-spun yarn in a drawing ratio of 1.2 to 5. The tensile strength of the sheath yarn or core yarn herein is determined by testing only the sheath yarn or core yarn each separated from the specimen combined filament yarn for breaking load, and then dividing the obtained breaking load by the fineness of the sheath yarn or the core.

The non-conductive polyethylene terephthalate multifilament yarn constituting the core of the combined filament yarn of the present invention generally has a yarn fineness of 20 to 100 deniers. The ratio by weight of the core to the sheath yarn is preferably in the range of from 1:2 to 5:1. It is preferred that the individual filaments of the non-conductive multifilament yarn constituting the core have a fineness of 0.5 to 15 deniers and those of the conductive filament constituting the sheath have a fineness of 2 to 25 deniers. In the present invention, the sheath yarn may either be a monofilament yarn or multifilament yarn.

The combined filament yarn of the present invention is obtained by feeding through separate feed rolls the non-conductive multifilament yarn that will constitute the core and the conductive composite filament that will constitute the sheath, doubling the two, and then passing the doubled yarn through an air intermingling nozzle or turbulent flow nozzle, thereby combining and intermingling the two yarns, followed by winding up.

On this occasion, the surface speed of the feed roll for the conductive composite filament is set higher than that for the core yarn, to achieve the afore-described difference in the yarn length. The yarn length difference also assures a construction of the obtained combined filament yarn in which the conductive composite filament constitutes the sheath and the non-conductive polyethylene terephthalate multifilament yarn the core. It is preferred for the purpose of protecting the conductive composite filament from suffering a high tension that the core and the sheath yarn be at least partly intermingled with each other by action of air flow or the like. In this case, the number of intermingled points is preferably 0.5 to 5 pieces/inch. The number of intermingled points can readily be determined by visually calculating the number of the points where the combined filament yarn does not become loose when it is permitted to float free on the surface of water. The combined filament yarn thus obtained may, as required, further be heat treated, preferably at 120° to 210° C. and under constant length or relaxed condition.

The combined filament yarn of the present invention is inserted into fabrics used for workwear and the like in a pitch of about 3 mm to 5 cm. Then the fabrics exhibit excellent antistatic properties when worn, even by repeated bending, crumpling, extension or like severe handling.

To summarize, the fact that the combined filament yarn of the present invention comprising the conductive composite yarn has the excellent antistatic properties and its durability in use is achieved by the following 5 points.

1. A polyamide having a specific moisture content is used for the conductive layer of the conductive filament;

2. A polyethylene terephthalate or polybutylene terephthalate polymer having high resistance against tensile extension is used for the sheath of the conductive filament;

3. The conductive filament is a highly oriented, undrawn composite filament and hence has low shrinkage in hot water and maintains its conductive layer unbroken because it has not been drawn;

4. In the combined filament yarn, the conductive filament is present as a sheath yarn having a larger yarn length than the yarn constituting the core, to prevent concentration of external force on itself; and 5. There is used as the core a drawn polyethylene multifilament yarn having higher Young's modulus and tensile strength than those of the sheath yarn, so that external force principally concentrates on the core.

The construction of above 1 through 5 assures the following:

The conductive layer of the conductive composite fiber hardly breaks by itself, and is also protected from breakage by action of the sheath component of the composite fiber and further by action of the core of the combined filament yarn. Thus, fabrics comprising the combined filament yarn of the present invention exhibit excellent antistatic properties over a long period of time as compared with fabrics utilizing conventional conductive filaments as they are.

Other features of the invention will become apparent from the following Examples which are given solely for the purpose of illustration and are not intended to limit the present invention in any way.

EXAMPLES

In the present invention, the electric resistance of the filament core is measured as follows.

Measurement of Electric Resistance of the Filament Core

Both ends of a 10-cm specimen of a composite filament are immersed in a pair of pot-shape electrodes filled with a conductive resin. Electric current at a voltage of 1 kV is measured. The electric resistance is calculated by Ohm's law and then divided by 10 (cm) and the number of filaments constituting the specimen to give a filament core resistance in Ω/cm·filament.

The critical elongation was measured in the present invention, by application of the above-described measurement of filament core resistance, according to the method described below. It may however be also measured by measuring an electric resistance of a specimen when elongated by using a tensile tester in combination with an electrode and resistance tester.

Measurement of Critical Elongation

Figure 2:
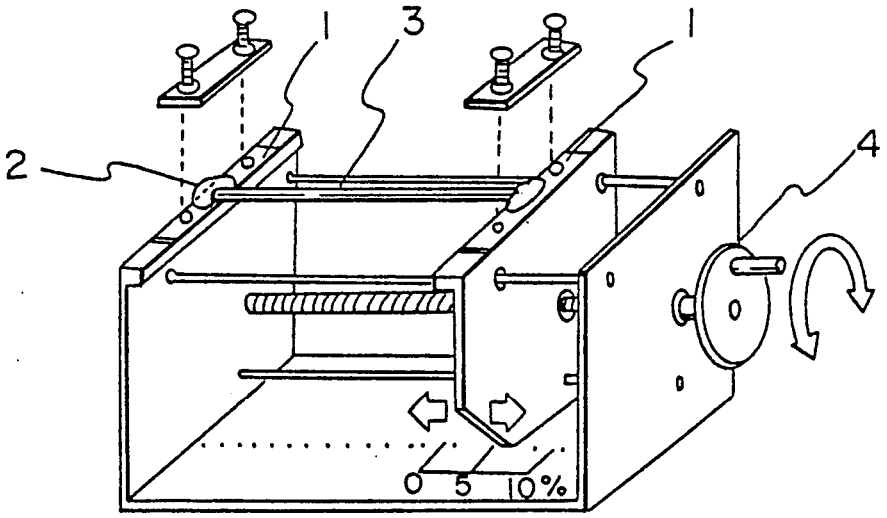
FIG. 2 is a schematic diagram showing the apparatus for measuring the critical elongation in the present invention.

FIG. 2 shows an example of the measuring apparatus. As seen from FIG. 2, an apparatus comprising a pair of electrodes (1) and a dial (4) for extending the specimen are used for measurement.

Both ends of a specimen (3) are each set on a pair of the electrodes (1) at a gauge length of 3 cm. A conductive paint is applied to both ends including the exposed core tip so that electric current can be sent therethrough, then both ends are fixed. Then the dial (4) is turned to elongate the specimen until it breaks while its electric resistance is being measured. The obtained values of electric resistance are converted to values per unit cm and the elongation (%) at which the electric resistance exceeds $1\times10^{11}$ Ω/cm·filament is obtained therefrom as the critical elongation.

The intrinsic viscosity, [n], of polyethylene terephthalate is measured at 30° C. in a 1/1 mixed solvent of phenol/tetrachloroethane. The intrinsic viscosity of nylon 6 is determined by measuring its solution in 96% $H_2SO_4$. The melt index of polyethylene is measured according to JIS-K6760.

EXAMPLE 1

Particle-incorporating chips having a volume specific resistance of $9\times10^2$ Ω·cm were obtained by melting and mixing 60 parts of a particulate titanium oxide having an average particle diameter of not more than 0.2 μ coated with 15% by weight of stannic oxide containing 2% by weight of antimonium oxide (hereinafter this conductive material is referred to as $W_1$) and 40 parts of nylon 6 chips ($Tm_1$=218° C.) at 270° C. The thus obtained chips were vacuum dried at 80° C. to a chip moisture content of 400 ppm (B). The chips (B) and conventional polyethylene terephthalate chips (A) ($Tm_2$−256° C. and [n] after spinning=0.63) were separately melted in two extruders and, using a composite-spinning apparatus, extruded through a spinneret having 4 holes at 295° C. into sheath-core composite filaments so that (B) and (A) formed the core and the sheath respectively in a (A)/(B) ratio by weight of 87/13, and the filaments were wound at a rate of 4,500 m/min while being divided into two to give two highly oriented conductive composite yarns of 25 deniers/2 filaments. The obtained yarns had a core resistance of $5\times10^{10}$ Ω/cm·filament and a critical elongation of 15%.

The thus obtained yarn was covered with a blended yarn of polyester (polyethylene terephthalate)/cotton=65/35 to give a core yarn. The core yarn was inserted into warps of a blended yarn of polyester (polyethylene terephthalate) fiber/cotton=65/35 having a cotton count of 20s/2 at an interval of 1 core yarn per 80 warps and woven into a 2/1 twill of 80 warps/in×50 wefts/in. The twill thus woven was dyed and finished under the usual finishing conditions for conventional polyester/cotton blended yarn fabric. The fabric thus obtained had a static charge of 4.5 μ Coulomb/m². A suit was tailored from the fabric and actually worn by a man for 1 year, while being washed 250 times during the period, and measured again for the static charge to give 5.5 μ Coulomb, which clears the standard of "Recommended Practice for Protection Against Hazards Arising out of Electricity" in "Technical Recommendations" issued by Research Institute of Industrial Safety of Labor Ministry, proving the excellent antistatic properties with superior durability of the conductive filament.

EXAMPLES 2 AND 3 AND COMPARATIVE EXAMPLES 1 AND 2

Example 1 was repeated except for changing the parts by weight of $W_1$. The data and results are shown in Table 1 below as Examples 2 and 3 and Comparative Examples 1 and 2.

In Examples 2 and 3, 65 parts by weight and 70 parts by weight of $W_1$ were respectively used to obtain conductive polymers having a volume specific resistance of both $4.1\times10^2$ Ω·cm, which were further formed under the same spinning conditions as in Example 1 into conductive composite filaments. These filaments both had critical elongations of at least 10% and a core resistance of $6\times10^9$ Ω/cm·filament, thus having excellent antistatic properties. The conductive composite filaments were woven into 2/1 twill fabrics, which were then dyed and finished, in the same manner as in Example 1. The fabrics thus obtained both showed a static charge of 3.5 μ Coulomb/m², and after 250 times of washing, showed a static charge of 4 to 4.3 μ Coulomb/m², which clears the standard, i.e. not more than 7 μ Coulomb/m², proving their excellent durability.

In Comparative Example 1, Example 1 was repeated except for changing the amount of $W_1$ to 55 parts by weight to obtain a composite filament. The obtained filament had a core resistance of $8\times10^{12}$ Ω/cm·filament and was not a filament having antistatic properties.

In Comparative Example 2, Example 1 was repeated except for changing the amount of $W_1$ to 80 parts by weight to obtain a conductive composite filament. Though the obtained filament had antistatic properties, the spinning operation was unstable because the life of the spinneret pack was very short due to filter clogging and the like.

EXAMPLES 4 AND 5 AND COMPARATIVE EXAMPLES 3 THROUGH 5

The influence of the moisture content of conductive polymer is demonstrated herein.

In Examples 4 and 5, Example 1 was repeated except for changing the moisture content of the polymer to 800 ppm and 1,100 ppm respectively to obtain conductive composite filaments under the same spinning conditions as in Example 1. These filaments had core resistances of $5\times10^9$ Ω/cm·filament and $6\times10^9$ Ω/cm·filament respectively and critical elongations of 15% and 5% respectively. The obtained conductive composite filaments were woven into 2/1 twill fabrics, which were then dyed and finished, in the same manner as in Example 1. The fabrics thus obtained showed static charges of from 3.5 to 4.0 μ Coulomb/m², and static charges after 250 times of washing of from 4.1 to 4.5 μ Coulomb/m², which clears the standard, proving their excellent durability.

In Comparative Examples 3 and 4, Example 1 was repeated except for changing the moisture content of the conductive polymer to 1,500 ppm and 2,000 ppm respectively under the same spinning conditions as in Example 1, in which case frequent filament breakages occurred. The obtained conductive composite filaments both had a core resistance of $8\times10^9$ Ω/cm·filament, which proved their high antistatic properties, but they had critical elongations as low as 1 to 2%. These filaments were woven into 2/1 twill fabrics, which were then dyed and finished, in the same manner as in Example 1. The filaments contained in the fabrics thus obtained showed core resistances after 250 times of washings of from $10^{10}$ to more than $10^{13}$ Ω/cm·filament, with cracks being observed in some portions of the conductive layer, thus being of inferior durability.

In Comparative Example 5, Example 1 was repeated except for changing the moisture content of the conductive polymer to 80 ppm under the same spinning conditions as in Example 1. Though the spinnability was good, many of the obtained conductive composite filaments showed a core resistance exceeding $10^{11}$ Ω/cm·filament, and further after the fabric incorporating the composite filament had been washed 250 times, cracks were observed in the conductive layer of the filament thus proving its inferior durability.

EXAMPLE 6

A conductive composite filament was obtained by extruding the conductive polymer used in Example 1 and a polybutylene terephthalate (Novadur 5008 made by Mitsubishi Chemical Industries Limited; $Tm_2$=226° C.) such that the former formed the core and the latter the sheath through a spinneret having 4 holes at 265° C. and the extruded filaments were divided into two and then wound at a rate of 3,750 m/min to give two 25 deniers/2 filaments yarns (core resistance; $5\times10^9$ Ω/cm·filament; critical elongation: 12%). The obtained conductive composite filament was woven into a 2/1 twill fabric, which was then dyed and finished, in the same manner as in Example 1. The fabric thus obtained showed a static charge of from 4.0 μ Coulomb/m², and a static charge after 250 times of washings of 4.5 μ Coulomb/m², proving the excellent durability of its antistatic properties.

EXAMPLES 7 AND 8

Particle-incorporating chips having a volume specific resistance of $3\times10^2$ Ω·cm were obtained by melting at 270° C. and mixing 64 parts of the same particulate conductive material, $W_1$, as in Example 1, 1 part of particulate stannic oxide containing antimonium oxide having an average particle diameter of 0.1 μ and 35 parts of nylon 6 chips. The thus obtained chips were vacuum dried at 80° C. to a chip moisture content of 400 ppm (B). Two types of conductive composite filaments were obtained with the thus obtained conductive polymer used for the core under the same spinning conditions as in Examples 1 and 6 respectively. These filaments had core resistances and critical elongations of $3\times10^9$ Ω/cm·filament and 10% and $4\times10^9$ Ω/cm·filament and 10%, respectively. The obtained conductive composite filaments were woven into 2/1 twill fabrics, which were then dyed and finished, in the same manner as in Example 1. The fabrics thus obtained both showed a static charge after 250 times of washing of 4.6 μ Coulomb/m$^2$, proving their excellent antistatic properties and durability.

COMPARATIVE EXAMPLE 6

A composite filament as spun was obtained under the same spinning conditions as in Example 4 except that the spinning speed was changed to 1,500 m/min. The as spun yarn, which had a maximum drawability of 4.53 times, was drawn by roller-plate system, at a hot roller temperature and a hot plate temperature of 75° C. and 120° C. respectively by 3.1 times to give a composite filament. Observation with a transmission-type electron microscope revealed that the conductive layer of the core had been torn to pieces. The filament had a core resistance of at least $10^{13}$ Ω/cm·filament and was not a filament having antistatic properties. No heat drawing conditions with the temperature and the drawing ratio varied while maintaining stable drawing could give a composite filament in which the conductive core layer was not broken and which had antistatic properties.

COMPARATIVE EXAMPLE 7

A conductive polymer was obtained by melting and mixing 65 parts of the conductive fine particles, $W_1$, used in Example 1, and 35 parts of polyethylene chips having a melt index of 50 g/10 min. A composite filament as spun was obtained using this polymer for the core under the same conditions as in Example 1 except for changing the spinning speed to 1,500 m/min. The thus obtained filament as spun was drawn by 3.0 times at a hot roller temperature and a hot plate temperature of 75° C. and 120° C. respectively to yield a conductive composite filament having a core resistance of $9\times10^9$ Ω/cm·filament and a critical elongation of 10%. The obtained conductive composite filament was woven into a 2/1 twill fabric, which was then dyed and finished, in the same manner as in Example 1. The fabric thus obtained showed a static charge of 4.2 μ Coulomb/m$^2$, which cleared the standard, but had a static charge after 250 times of washings of 7.8 μ Coulomb/m$^2$, thus being of no durability.

COMPARATIVE EXAMPLE 8

A composite filament having a low wet shrinkage was obtained under the same spinning conditions as in Example 1 (i.e. spinning speed: 4,500 m/min; no heat drawing) except for using the conductive polymer prepared in Comparative Example 7 as the core. Though the obtained filament had antistatic properties, it did not have a durability similar to the one obtained in Comparative Example 7.

EXAMPLE 9 AND COMPARATIVE EXAMPLES 9 AND 10

The influence of the sheath-core composite ratio is illustrated herein.

In Example 9, the same conductive component as in Example 2 was used as the core component and Example 1 was repeated except for changing the sheath-core composite ratio to 17/83. The spinnability and the durability of antistatic properties of the obtained fabric were both excellent as shown in Table 1.

In Comparative Example 9, the ratio of the conductive component to the sheath wa further increased to 30/70. Frequent filament breakages occurred in the spinning process and stable spinning was not accomplished.

In Comparative Example 10, the ratio of the conductive component to the sheath component was 4/96. Though the spinnability was good, a conductive filament having antistatic properties was not obtained.

EXAMPLE 10 AND COMPARATIVE EXAMPLE 11

The influence of the intrinsic viscosity, [n], after spinning of polyethylene terephthalate used for the sheath is illustrated herein.

The spinning operation of Example 1 was repeated except that the [n] after spinning were 0.58 (Example 10) and 0.52 (Comparative Example 11). While the filament obtained in Example 10 had excellent antistatic properties with durability, in Comparative Example 11 frequent filament breakages occurred and stable spinning was not attained.

EXAMPLE 11

Particle-incorporating chips having a volume specific resistance of $4\times10^2$ Ω·cm were obtained by melting and mixing 65 parts of the same particulate conductive material, $W_1$, as in Example 1, and 35 parts of metaxylylenediamine nylon chips made by Mitsubishi Gas Chemical Company, Inc. The thus obtained chips were dried to a moisture content of 400 ppm and then formed into a conductive composite filament under the same spinning conditions as in Example 1. The filament had a core resistance and a critical elongation of $2\times10^{10}$ Ω/cm·filament and 15% respectively. The fabric incorporating the thus obtained filament showed a static charge after 250 times of washings of 6.5 μ Coulomb/m$^2$, proving its excellent antistatic properties with durability.

EXAMPLE 12

Particle-incorporating chips having a volume specific resistance of $4\times10^{10}$ Ω·cm were obtained by melting and mixing 73 parts of the same particulate conductive material, $W_1$, as in Example 1, and 35 parts of nylon 12 chips made by Ube Industries, Ltd. The thus obtained chips were dried to a moisture content of 400 ppm. A conductive composite filament was obtained with the thus prepared chips as the core and polybutylene terephthalate as the sheath under the same spinning conditions as in Example 6. The filament had a core resistance and a critical elongation of $8\times10^9$ Ω/cm·filament and 15% respectively and thus had antistatic properties. The fabric incorporating the thus obtained filament in the same manner as in Example 1 showed a static charge of 3.7 μ Coulomb/m$^2$ and a static charge after 250 times of washings of 5.0 μ Coulomb/m$^2$, which cleared the standard and proved its excellent durability of antistatic properties.

EXAMPLE 13

Nylon 6 was used as the sheath component. Example 1 was repeated except for using nylon 6 as the sheath and changing the spinning speed and temperature to 3,500 m/min and 270° C. respectively. The obtained composite filament had a core resistance and a critical elongation of $6\times10^9$ Ω/cm·filament and 10% respectively and thus had antistatic properties. The fabric incorporating the thus obtained filament in the same manner as in Example 1 and washed 250 times had a static charge of 5.5 μ Coulomb/m$^2$, which cleared the standard.

COMPARATIVE EXAMPLE 12

Example 1 was repeated except for changing the spinning speed to 2,000 m/min. The obtained filament had a shrinkage in hot water at 100° C. of 28%. The finished fabric contained the composite filament under high tension. Though the fabric initially showed good antistatic properties, it completely lost the properties after being worn for some period.

EXAMPLE 14

A combined filament yarn was prepared using as the sheath the highly oriented, undrawn, conductive filament yarn of 25 deniers/2 filaments obtained in Example 1 and having a core resistance of $5\times10^{10}$ Ω/cm·filament, a critical elongation of 15%, a tensile strength of 3.5 g/d ("d" herein stands for "denier"; hereinafter the same will apply) and a Young's modulus of 74 g/d. As the core, a polyethylene terephthalate multifilament yarn of 30 deniers/24 filaments and having a tensile strength of 5.0 g/d and a Young's modulus of 110 g/d was prepared by spinning at a take-up speed of 1,200 m/min and drawing with a hot roller at 78° C. and a hot plate at 150° C. in a drawing ratio of 3.5.

The above conductive filament yarn and polyethylene terephthalate multifilament yarn were fed through separate feed rolls, the former at a speed of 55.5 m/min and the latter at 54.0 m/min, doubled, and then combined and intermingled through an intermingling nozzle with an air of 4.0 kg/cm$^2$. The thus combined yarn was taken up on a take-up roll at a speed of 54.0 m/min and then wound up. The combined filament yarn thus obtained had a number of intermingled points of 1.5 pieces/inch. The difference in yarn length between the core and the sheath was 2.5%.

Observation with an optical microscope on the combined yarn revealed that the polyethylene terephthalate multifilament yarn was located at nearly the central part around which the conductive filament yarn attach and coil, though in not so complete a form.

The combined filament yarn was incorporated into a 2/1 twill in the same manner as in Example 1. The twill was tailored into a suit, which was then actually worn for 1 year in the same manner as in Example 1, while being washed 250 times during the period. Thereafter, the suit was tested for static charge to give 4.8 μ Coulomb/m$^2$ and the combined filament yarn for core resistance to give $6\times10^{10}$ Ω/cm·filament, proving higher durability of its antistatic properties than that with the fabric obtained in Example 1.

EXAMPLE 15

A combined filament yarn was prepared in the same manner as in Example 14, using as the sheath the conductive filament yarn obtained in Example 6 with a sheath component of polybutylene terephthalate and having a core resistance of $5\times10^{9}$ Ω/cm·filament, critical elongation of 12%, tensile strength of 2.8 g/d and Young's modulus of 45 g/d. The combined filament yarn thus prepared was incorporated into a 2/1 twill, which was then formed into a suit, in the same manner as in Example 1. The suit was actually worn for 1 year during which it was washed 250 times. After the wearing test, the suit showed a static charge of 4.2 μ Coulomb/m$^2$ and the combined filament yarn a core resistance of $7\times10^{9}$ Ω/cm·filament, thus proving far higher durability than the case where the conductive filament is used as it is as in Example 6.

COMPARATIVE EXAMPLE 13

Example 14 was repeated except that the conductive filament and the polyethylene terephthalate multifilament yarn were fed at the same speed of 54 m/min, to prepare a combined filament yarn. Observation with an optical microscope on this combined filament yarn revealed that the two yarns were, with no difference in yarn length, united simply by lying side by side and that there was no appreciable discrimination between the core and the covering yarn.

The combined filament yarn thus prepared was inserted into a 2/1 twill, which was then tailored into a suit, in the same manner as in Example 1. The suit was actually worn for 1 year, while being washed 250 times during the period, and then tested for static charge to give 5.8 μ Coulomb/m$^2$. The combined filament yarn was taken out and tested for core resistance to give $9\times10^{10}$ Ω/cm·filament. These results were poorer than those obtained in Example 14. This is attributable to the polyethylene terephthalate multifilament yarn of the combined yarn having insufficiently functioned to support external tensile stresses.

COMPARATIVE EXAMPLE 14

Example 14 was repeated except for using, instead of the polyethylene terephthalate multifilament yarn, a 6-nylon multifilament yarn of 30 deniers/24 filaments having a tensile strength of 3.9 g/d and a Young's modulus of 41 g/d and obtained by spinning at a take-up speed of 1,000 m/min and, without being wound up, successively drawing in a drawing ratio of 2.5, to prepare a combined filament yarn. The combined filament yarn thus prepared was, in the same manner as in Example 14, incorporated into a 2.1 twill, which was formed into a suit, the suit being worn for 1 year while washed 250 times during the period. After the wearing test, the suit showed a static charge of 5.9 μ Coulomb/m$^2$ and the combined filament yarn a core resistance of $1\times10^{11}$ Ω/cm·filament. These results showed that nylon-6 as a partner combined will not exhibit the function of supporting external stresses.

Obviously, numerous modifications and variations of the present invention are possible in light of the above teachings. It is therefore to be understood that within the scope of the appended claims, the invention may be practiced otherwise than as specifically described herein.

| | Core component (B) | | | | | Sheath component (A) | | | Spinning conditions | | | |
|---|---|---|---|---|---|---|---|---|---|---|---|---|
| | Polymer | $Tm_1$ (°C.) | Mixing ratio by weight of conductive particles (%) $W_1$ | $T_1$ | Moisture content of conductive polymer (ppm) | Polymer | $Tm_2$ (°C.) | [η] after spinning | Core-sheath ratio B/A | Spinning speed (m/min) | spinnability | Remarks |
| Ex. 1 | Nylon 6 | 218 | 60 | 0 | 400 | polyethylene terephthalate | 256 | 0.63 | 13/87 | 4500 | ◎ | |
| Ex. 2 | " | " | 65 | 0 | " | polyethylene terephthalate | " | " | " | " | ◎ | |
| Ex. 3 | " | " | 70 | 0 | " | polyethylene terephthalate | " | " | " | " | ◎ | |
| Comp. Ex. 1 | " | " | 55 | 0 | " | polyethylene terephthalate | " | " | " | " | ◎ | |
| Comp. Ex. 2 | " | " | 80 | 0 | " | polyethylene terephthalate | " | " | " | " | X | Unstable spinning to filter clogging and the like |
| Ex. 4 | " | " | 65 | 0 | 800 | polyethylene terephthalate | " | " | " | " | ◎ | |
| Ex. 5 | " | " | " | | 1100 | polyethylene terephthalate | " | " | " | " | ○ | |
| Comp. Ex. 3 | " | " | " | | 1500 | polyethylene terephthalate | " | " | " | " | X | Frequent filament breakage |
| Comp. Ex. 4 | " | " | " | | 2000 | polyethylene terephthalate | " | " | " | " | X | |
| Comp. Ex. 5 | " | " | " | | 80 | polyethylene terephthalate | "" | " | " | ◎ | | |
| Ex. 6 | " | " | " | | 400 | polybutylene terephthalate | 226 | 0.82 | " | 3750 | ◎ | |
| Ex. 7 | " | " | 64 | 1 | " | polybutylene terephthalate | " | " | " | " | ◎ | |
| Ex. 8 | " | " | " | | " | polyethylene terephthalate | 256 | 0.63 | " | 4500 | ◎ | |

TABLE 1 (2)

| | Antistatic property and its durability | | | | | | | |
|---|---|---|---|---|---|---|---|---|
| | Heat drawing | Core resistance (Ω/cm · f) | Antistatic property | Critical elongation (%) | (μC/m²) | Performance after one-year service (washed 250 times) Core resistance (Ω/cm · f) | (μC/m²) | Overall evaluation |
| Ex. 1 | No | $5 \times 10^{10}$ | ◎ | 15 | 4.5 | $7 \times 10^{10}$ | 5.5 | ◎ |
| Ex. 2 | " | $6 \times 10^{9}$ | ◎ | 15 | 3.5 | $8 \times 10^{9}$ | 4.0 | ◎ |
| Ex. 3 | " | $6 \times 10^{9}$ | ◎ | 10 | 3.5 | $1 \times 10^{10}$ | 4.3 | ◎ |
| Comp. Ex. 1 | " | $8 \times 10^{12}$ | X | 17 | — | — | — | X |
| Comp. Ex. 2 | " | $6 \times 10^{9}$ | ◎ | 10 | — | — | — | X |
| Ex. 4 | " | $5 \times 10^{9}$ | ◎ | 15 | 3.5 | $9 \times 10^{9}$ | 4.1 | ◎ |
| Ex. 5 | " | $6 \times 10^{9}$ | ◎ | 5 | 4.0 | $2 \times 10^{10}$ | 4.5 | ○~◎ |
| Comp. Ex. 3 | " | $8 \times 10^{9}$ | ◎ | 2 | 3.7 | $10^{10} \times 10^{13} <$ | 7.2 | Δ~X |
| Comp. Ex. 4 | " | $8 \times 10^{9}$ | ◎ | 0 | — | — | — | X |
| Comp. Ex. 5 | " | $10^{10} \sim 10^{13}$ | ◎ | 0 | 6.8 | $10^{13} <$ | 8.7 | X |
| Ex. 6 | " | $5 \times 10^{9}$ | ◎ | 12 | 4.0 | $1 \times 10^{10}$ | 4.5 | ◎ |
| Ex. 7 | " | $3 \times 10^{9}$ | ◎ | 10 | 3.1 | $8 \times 10^{9}$ | 4.6 | ◎ |
| Ex. 8 | " | $4 \times 10^{9}$ | ◎ | 10 | 4.0 | $8 \times 10^{9}$ | 4.6 | ◎ |

TABLE 1 (3)

| | Core component (B) | | | | | Sheath component (A) | | | Spinning conditions | | | |
|---|---|---|---|---|---|---|---|---|---|---|---|---|
| | Polymer | $Tm_1$ (°C.) | Mixing ratio by weight of conductive particles (%) $W_1$ | $T_1$ | Moisture content of conductive polymer (ppm) | Polymer | $Tm_2$ (°C.) | [η] after spinning | Core-sheath ratio B/A | Spinning speed (m/min) | spinnability | Remarks |
| Comp. Ex. 6 | nylon 6 | 218 | 65 | 0 | 800 | polyethylene terephthalate | 255 | 0.63 | 13/87 | 1500 | ◎ | |
| Comp. Ex. 7 | polyethylene | 127 | " | | — | polyethylene terephthalate | " | " | " | " | ◎ | |
| Comp. Ex. 8 | " | " | " | | — | polyethylene terephthalate | 256 | " | " | 4500 | ◎ | |
| Ex. 9 | nylon 6 | 218 | " | | 400 | polyethylene terephthalate | " | " | 17/83 | " | ○ | |
| Comp. | " | " | " | | " | polyethylene | " | " | 30/70 | " | X | Frequent |

TABLE 1 (3)-continued

| | Core component (B) | | | | | Sheath component (A) | | | Spinning conditions | | | |
|---|---|---|---|---|---|---|---|---|---|---|---|---|
| | Polymer | $Tm_1$ (°C.) | Mixing ratio by weight of conductive particles (%) $W_1$ | $T_1$ | Moisture content of conductive polymer (ppm) | Polymer | $Tm_2$ (°C.) | [η] after spinning | Core-sheath ratio B/A | Spinning speed (m/min) | spinnability | Remarks |
| Ex. 9 | | | | | | terephthalate | | | | | | filament breakage |
| Comp. Ex. 10 | " | " | " | | " | polyethylene terephthalate | " | " | 4/96 | " | ◎ | |
| Ex. 10 | " | " | " | | " | polyethylene terephthalate | " | 0.58 | 13/87 | " | ◎ | |
| Comp. Ex. 11 | " | " | " | | " | polyethylene terephthalate | " | 0.52 | " | " | X | Frequent filament breakage |
| Ex. 11 | metaxylylene-diamine nylon | 223 | 65 | 0 | " | polyethylene terephthalate | 256 | 0.63 | " | 4500 | ◎ | |
| Ex. 12 | nylon 12 | 180 | " | | " | polybutylene terephthalate | 226 | 0.82 | " | 3750 | ◎ | |
| Ex. 13 | nylon 6 | 218 | " | | " | nylon 6 | 218 | 1.01 | " | 3500 | ◎ | |
| Comp. Ex. 12 | " | " | 60 | 0 | " | polyethylene terephthalate | 256 | 0.63 | " | 2000 | ◎ | |

TABLE 1 (4)

| | Antistatic property and its durability | | | | | | | |
|---|---|---|---|---|---|---|---|---|
| | Heat drawing | Core resistance (Ω/cm · f) | Antistatic property | Critical elongation (%) | (μC/m²) | Performance after one-year service (washed 250 times) Core resistance (Ω/cm · f) | (μC/m²) | Overall evaluation |
| Comp. Ex. 6 | Yes | $10^{13}$< | X | — | — | — | — | X |
| Comp. Ex. 7 | " | $9 \times 10^9$ | ◎ | 10 | 4.2 | $10^{13}$ < | 7.8 | X |
| Comp. Ex. 8 | No | $5 \times 10^9$ | ◎ | 10 | 3.5 | $10^{13}$ < | 7.6 | X |
| Ex. 9 | " | $3 \times 10^9$ | ◎ | 10 | 3.5 | $9 \times 10^9$ | 4.4 | ○~◎ |
| Comp. Ex. 9 | " | — | — | — | — | — | — | X |
| Comp. Ex. 10 | " | $5 \times 10^{11}$ | X | — | — | — | — | X |
| Ex. 10 | " | $9 \times 10^9$ | ◎ | 10 | 4.0 | $2 \times 10^{10}$ | 5.2 | ◎ |
| Comp. Ex. 11 | " | — | — | — | — | — | — | X |
| Ex. 11 | No | $2 \times 10^{10}$ | ◎ | 15 | 5.5 | $7 \times 10^{10}$ | 6.5 | ◎ |
| Ex. 12 | " | $8 \times 10^9$ | ◎ | 15 | 3.7 | $5 \times 10^{10}$ | 5.0 | ◎ |
| Ex. 13 | " | $6 \times 10^9$ | ◎ | 10 | 3.5 | $9 \times 10^9$ | 5.5 | ○ |
| Comp. Ex. 12 | " | $8 \times 10^9$ | ◎ | 15 | 4.5 | $10^{13}$ < | 10.0 | X |

What is claimed is:

1. A combined filament yarn comprising:

(1) a core of non-conductive polyethylene terephthalate multifilament yarn surrounded by (2) a sheath of highly oriented, undrawn, conductive filament yarn, the filaments of said yarn each comprising:

(a) a conductive polyamide core containing therein at least one conductive metal oxide, said polyamide core having been adjusted to a moisture content of from about 100 to 1200 ppm during spinning of said conductive filament yarn, said polyamide core surrounded by (b) a polyethylene terephthalate or polybutylene terephthalate sheath; wherein, said conductive filament yarn exhibits a resistance at a DC voltage of 1 kV of less than $9 \times 10^{10}$ Ω/cm., filament, a critical elongation of at least 5%, a shrinkage in hot water at 100° C. of 20% or less, and a yarn length of 0.5 to 15% greater than that of said non-conductive polyethylene terephthalate core, and wherein the conductive filament yarn has a Young's modulus and tensile strength smaller than that of said non-conductive polyethylene terephthalate core, said non-conductive polyethylene terephthalate core and said conductive filament yarn sheath being at least partially intermingled to form said combined filament yarn.

2. A combined filament yarn according to claim 1 wherein the non-conductive polyethylene terephthalate multifilament yarn of the core has a total fineness of 20 to 100 denier.

3. A combined filament yarn according to claim 1 wherein the weight ratio of the yarn comprising the non-conductive core to the yarn comprising the conductive sheath ranges from 1:2 to 5:1.

* * * * *